US010135192B2

(12) United States Patent
Yang et al.

(10) Patent No.: US 10,135,192 B2
(45) Date of Patent: Nov. 20, 2018

(54) SELF-TERMINATING BACKPLANE CONNECTOR

(71) Applicant: CISCO TECHNOLOGY, INC., San Jose, CA (US)

(72) Inventors: Yaochao Yang, Fremont, CA (US); Hui Wu, Cupertino, CA (US); Soumya De, Santa Clara, CA (US)

(73) Assignee: Cisco Technology, Inc., San Jose, CA (US)

( * ) Notice: Subject to any disclaimer, the term of this patent is extended or adjusted under 35 U.S.C. 154(b) by 0 days.

(21) Appl. No.: 15/455,281

(22) Filed: Mar. 10, 2017

(65) Prior Publication Data

US 2018/0261959 A1 Sep. 13, 2018

(51) Int. Cl.

| | |
|---|---|
| ***H01R 29/00*** | (2006.01) |
| ***H01R 13/6461*** | (2011.01) |
| ***H01R 13/11*** | (2006.01) |
| ***H01R 43/26*** | (2006.01) |

(52) U.S. Cl.
CPC ..... *H01R 13/6461* (2013.01); *H01R 13/111* (2013.01); *H01R 43/26* (2013.01)

(58) Field of Classification Search
CPC ..... H01R 13/6658; H01R 13/6625; H01R 13/6485
See application file for complete search history.

(56) References Cited

U.S. PATENT DOCUMENTS

| | | | | |
|---|---|---|---|---|
| 3,784,950 | A | 1/1974 | Coffman | |
| 4,971,569 | A | 11/1990 | Gooch et al. | |
| 5,076,797 | A | 12/1991 | Moulton | |
| 5,601,441 | A | 2/1997 | Weinstein et al. | |
| 6,612,856 | B1 * | 9/2003 | McCormack ..... | H01R 13/6485 200/51.1 |
| 6,780,035 | B2 * | 8/2004 | Bohbot ..... | H01R 13/6485 439/108 |
| 7,896,672 | B2 * | 3/2011 | Felisilda De La Cruz ..... | H01R 13/6625 200/51.1 |
| 9,548,570 | B2 | 1/2017 | Laurx et al. | |
| 2008/0318455 | A1 | 12/2008 | Beaman et al. | |

* cited by examiner

*Primary Examiner* — Xuong Chung Trans
(74) *Attorney, Agent, or Firm* — Cindy Kaplan

(57) ABSTRACT

In one embodiment, an apparatus includes a contact contained within a connector configured to couple with a mating connection to provide a communications data path through the connector, a ground shroud extending over a portion of the contact, and a self-terminating element connected to one of the contact and the ground shroud and configured for engagement with the other of the contact and the ground shroud when in an engaged position with the connector uncoupled from the mating connection to terminate signals transmitted to the connector, and disengagement when in a disengaged position with the connector coupled with the mating connection.

19 Claims, 13 Drawing Sheets

SELF-TERMINATING BACKPLANE CONNECTOR

TECHNICAL FIELD

The present disclosure relates generally to data communications connectors, and more particularly, termination of signals for uncoupled connectors.

BACKGROUND

High-speed backplane connectors (e.g., backplane, midplane, orthogonal midplane, or orthogonal direct connectors) are widely used in communications, computing, storage, and other systems to interconnect different service cards and form a complete data path. During normal operation, all links are connected to transceivers on each side of the link. If a service card is removed, a transmitter may continue to transmit data on the open link until the system disables the open link.

BRIEF DESCRIPTION OF THE DRAWINGS

Corresponding reference characters indicate corresponding parts throughout the several views of the drawings.

DESCRIPTION OF EXAMPLE EMBODIMENTS

Overview

Figure 1:
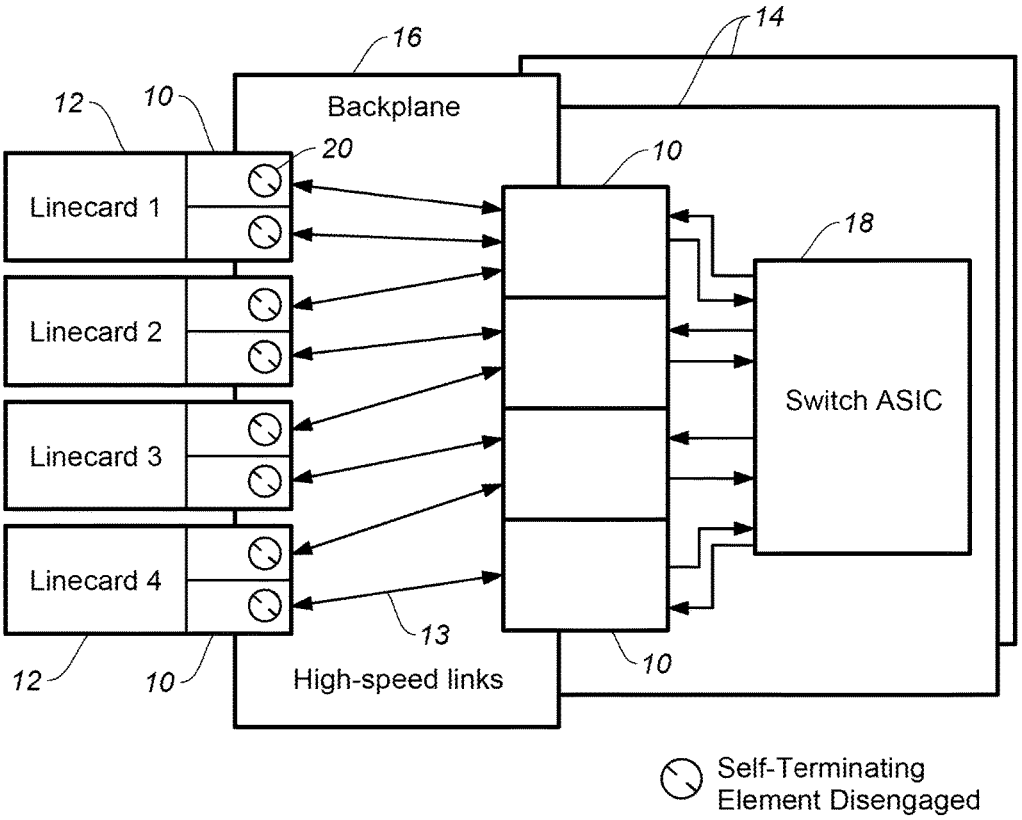
FIG. 1 is a block diagram of a high-speed interconnection with connectors comprising self-terminating elements in a fully populated switch, in accordance with one embodiment.

In one embodiment, an apparatus generally comprises a contact contained within a connector configured to couple with a mating connection to provide a communications data path through the connector, a ground shroud extending over a portion of the contact, and a self-terminating element connected to one of the contact and the ground shroud and configured for engagement with the other of the contact and the ground shroud when in an engaged position with the connector uncoupled from the mating connection to terminate signals transmitted to the connector, and disengagement when in a disengaged position with the connector coupled with the mating connection.

In another embodiment, an apparatus generally comprises a connector configured to couple with a mating connection, the connector comprising a plurality of contacts configured to mate with the mating connection to provide a communications data path through the connector, and a plurality of self-terminating elements, each of the self-terminating elements operable to move between a disengaged position when the connector is coupled to the mating connection and an engaged position when the connector is uncoupled from the mating connection. The signals are transmitted across the contacts to the mating connection when the self-terminating elements are in the disengaged position and the signals are terminated to ground when the self-terminating elements are in the engaged position.

In yet another embodiment, a method generally comprises transmitting a signal received from a network device at a backplane connector to a mating connection and terminating the signal at a self-terminating element at the backplane connector upon removal of the mating connection from the backplane connector. The self-terminating element is movable from a disengaged position when the backplane connector is coupled to the mating connection to allow the signal to pass therethrough, to an engaged position when the mating connection is removed from the backplane connector to terminate the signal. The self-terminating element is connected to one of a signal contact and a ground shroud extending over a portion of the signal contact, and configured to engage the other of the signal contact and the ground shroud when the self-terminating element is in the engaged position.

Example Embodiments

The following description is presented to enable one of ordinary skill in the art to make and use the embodiments. Descriptions of specific embodiments and applications are provided only as examples, and various modifications will be readily apparent to those skilled in the art. The general principles described herein may be applied to other applications without departing from the scope of the embodiments. Thus, the embodiments are not to be limited to those shown, but are to be accorded the widest scope consistent with the principles and features described herein. For purpose of clarity, details relating to technical material that is known in the technical fields related to the embodiments have not been described in detail.

Network devices such as switches, routers, server racks, or other devices may be configured with a midplane, backplane, or orthogonal-direct attached architecture in which high-speed connectors (referred to herein as backplane connectors) are used to interconnect different service cards.

Service cards may need to be replaced or upgraded, which involves the removal of one or more service cards without interrupting traffic going through other connected links. If service cards are removed and data continues to be transmitted on the open links, signals may cause harmful crosstalk to adjacent active links still in operation. System software may be used to disable these open links and configure transmitters on a card to a proper termination. However, this may take a period of time for the system software to detect and confirm the open links, and then disable the transceivers with a proper termination state. During this transition period of time, the links are open and the transmitters continue to transmit signals. This can significantly increase crosstalk noise to adjacent active links and cause an increase in link failure rates. This issue becomes more critical as the transmitted data rate continues to increase and the modulation scheme transitions, for example, from NRZ (Non-Return to Zero) to PAM4 (Pulse Amplitude Modulation-4), or higher order of modulation. It is, therefore, important to reduce the transition time and mitigate the overall impact due to open links caused by removal of service cards.

The embodiments described herein provide automatic self-termination for uncoupled connectors. As described in detail below, one or more embodiments include a mechanism and termination scheme within a connector that engages when the connector is disconnected (unplugged, uncoupled), and disengages when the connector is connected (plugged, coupled). One or more embodiments may help to improve the performance and reliability of network devices in which service cards are removed for repair or upgrade. The embodiments may be implemented with various types of connectors used, for example, within the telecommunications industry, computer industry, or other industries.

In one or more embodiments, the self-termination feature may be implemented in a backplane connector configured for high-speed data rate transmittal. It is to be understood that the term "backplane connector" as used herein may refer to a backplane connector, midplane connector (connections on both sides), orthogonal (backplane or midplane) connector (vertical connection on one side, horizontal connection on other side), orthogonal direct (also referred to as ortho-direct), plane-less orthogonal direct attached, coplanar, mezzanine, or any other type of connector, including those with opposite ends oriented at any angle or direction relative to one another, and used for interconnection to a network device (e.g., server, switch, rack), backplane, midplane, service card (e.g., linecard, fabric card, switch card, off-load processing engines) or similar connection in a data communications network.

Referring now to the drawings, and first to FIG. 1, a block diagram illustrating an interconnection (e.g., high-speed interconnection) utilizing connectors 10 in a fully populated switch is shown, in accordance with one embodiment. The system includes six slots, with four slots used for linecard insertion and two slots for switch (fabric) card insertion. In this example, the fully populated system comprises four linecards 12 (Linecard 1, Linecard 2, Linecard 3, Linecard 4) and two switch cards 14. The linecards 12 and fabric cards 14 are interconnected at a backplane 16 through two connectors for each linecard and four connectors for each of the fabric cards.

The connectors 10 are an integral part of high-speed links 13 and may include, for example, a header portion (e.g., attached to the backplane 16) and a receptacle portion (also referred to as a plug) (e.g., attached to the linecard 12 or switch card 14). The connector 10 provides a data communication path between the fabric card 14 and linecard 12 when coupled and allows for communication between the linecards 10 and switch 18. In this manner, all of the links 13 are properly connected to transceivers (not shown) on each side of the link (linecard 12 and fabric card 14) and are properly terminated by the transceivers in normal operation.

Figure 2:
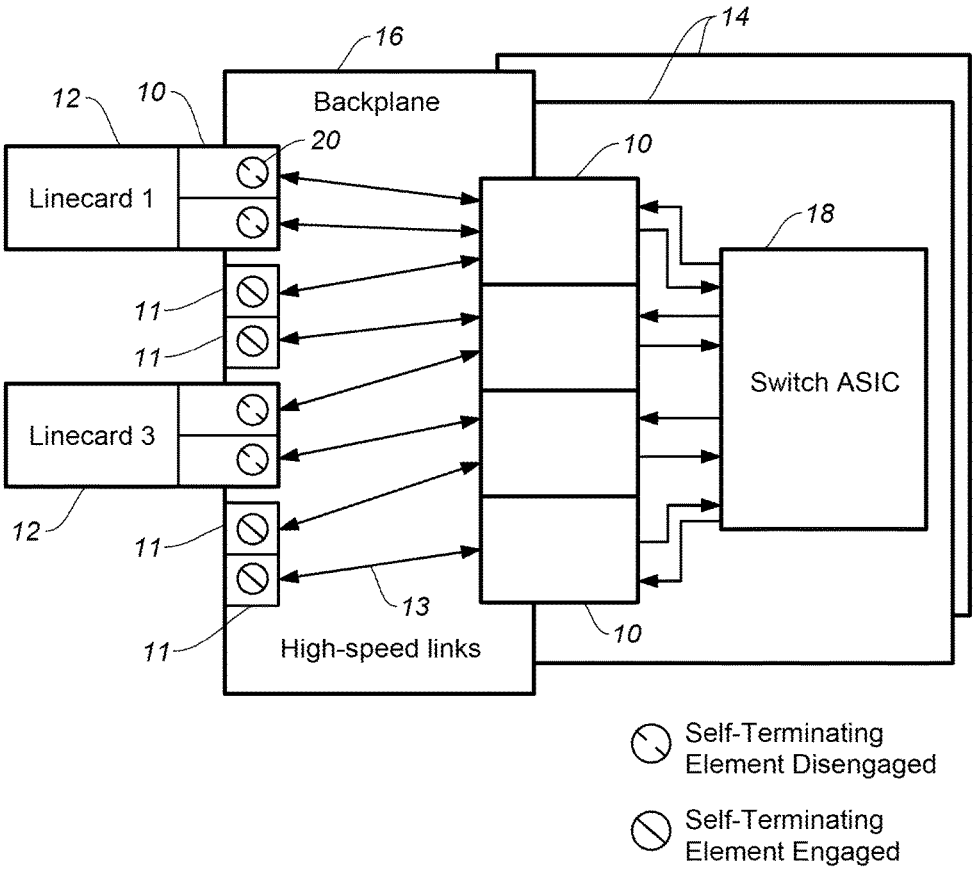
FIG. 2 shows the diagram of FIG. 1 with two linecards removed and corresponding self-terminating elements engaged.

Referring now to FIG. 2, a block diagram for a partially populated backplane of the switch system of FIG. 1 is shown. In this example, linecard 2 and linecard 4 have been removed. Due to the removal of these linecards, the corresponding links 13 are now open at the interface of the connector (e.g., on the header side 11) at slots 2 and 4 (corresponding to removed linecards 2 and 4) (FIGS. 1 and 2). If the transmitter on the switch cards 14 continues to transmit data, the signals would be reflected at the open ends of the header portion 11 of the connector and may cause harmful crosstalk to adjacent active links still in operation on the fabric (switch) cards 14.

As described in detail below, one or more of the connectors 10 may include an automatic self-terminating feature 20, which provides a termination scheme within the connector 10 when the connector is disconnected (unplugged, uncoupled). When the connectors 10 are connected (plugged, coupled) (all connectors 10 in FIG. 1), the self-terminating elements 20 are disengaged, allowing communications on the links 13. When the connector 10 is uncoupled (e.g., connectors with linecards 2 and 4 removed in FIG. 2), the self-terminating element 20 is engaged to maintain the connector signal pin in a terminated state. This reduces the impact of open signal paths when the service card 12 is removed from a rack system or other network device.

The self-termination feature 20 may be included on all connectors 10 or only a portion of the connectors (e.g., only linecard connectors in FIGS. 1 and 2). As described in detail below, the self-terminating element 20 may be located on a header portion of the connector or a receptacle portion of the connector, and is operable to move from a disengaged position when the connector 10 is coupled to a mating connection (e.g., linecard 12 or backplane 16) to an engaged position when the connector 10 is uncoupled from the mating connection (e.g., receptacle portion in mating connection at linecard 12 removed from header portion in connector 10). The self-terminating elements 20 are further operable to move from an engaged position when the connectors are uncoupled to a disengaged position when the connectors are coupled.

It is to be understood that the system shown in FIGS. 1 and 2 and described above is only an example and the embodiments described herein may be implemented in other configuration systems, network devices, or components, without departing from the scope of the embodiments. For example, the service cards may be directly connected without the use of a backplane. Also, the rack may include any number of linecards, fabric cards, or any other service cards. The connectors may be used, for example, with any communications, computing, or storage rack equipment. In one or more embodiments, the connectors may be used in a high-speed system (e.g., data rate greater than 40 Gb/s, 50 Gb/s, 100 Gb/s, or 200 Gb/s) or any other data rate system (e.g., less than 40 Gb/s, 50 Gb/s or other data rate (e.g., 30 Gb/s, 10 Gb/s, 5 Gb/s, etc.).

Figure 3A:
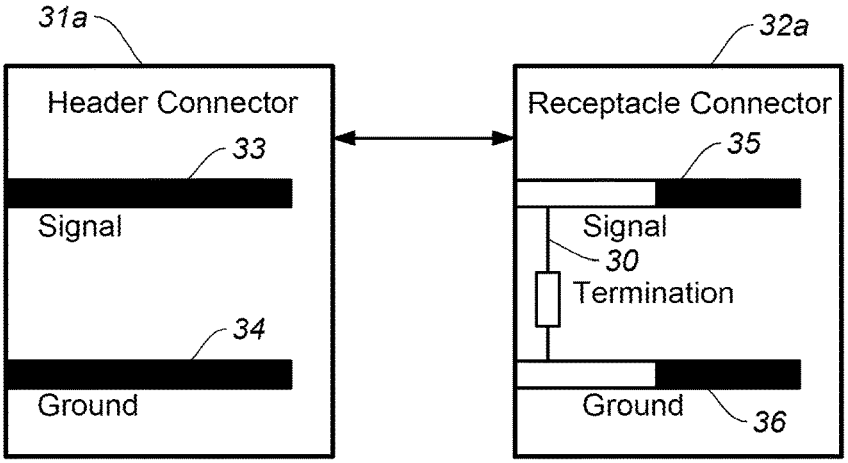
FIG. 3A is a block diagram of mating connectors with the self-terminating element on a receptacle portion of the connector, in accordance with one embodiment.
Figure 3B:
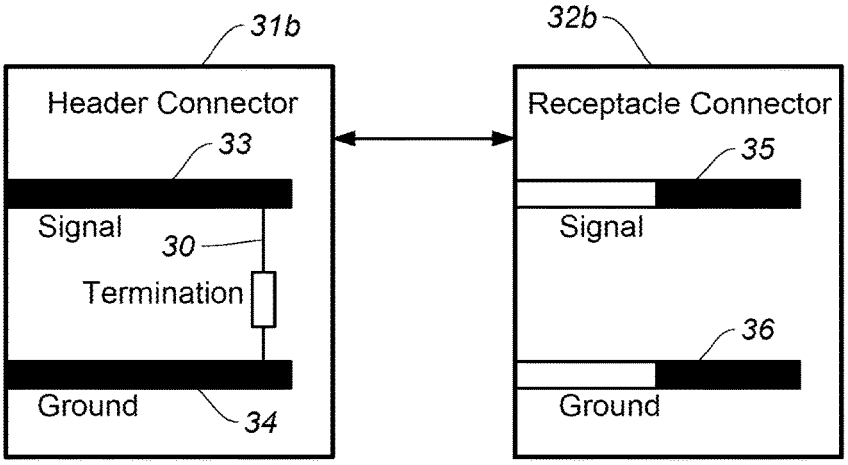
FIG. 3B is a block diagram of the mating connectors with the self-terminating element on a header portion of the connector, in accordance with another embodiment.

FIGS. 3A and 3B are block diagrams illustrating examples of connections comprising a header portion (header, header connector) 31*a*, 31*b* and a receptacle portion (receptacle, receptacle connector) 32*a*, 32*b*. In FIG. 3A, a single-ended termination (self-terminating element) 30 is located in the receptacle 32*a* and in FIG. 3B, the self-terminating element is located in the header 31*b*. The self-terminating element 30 is shown in an engaged position, in which signals received at the connector (e.g., receptacle 32*a* in FIG. 3A, header 31*b* in FIG. 3B) are terminated to ground since the connectors are shown uncoupled (disconnected, unplugged).

The header 31*a*, 31*b* comprises one or more signal pins (contact) 33 and ground 34 configured to mate with one or more receptacle pins (contact) 35 and ground 36 in the receptacle 32*a*, 32*b* to create a data path through the connection (header connector and receptacle connector).

The termination 30 may comprise, for example, a 50 ohm load (or other resistance load) that is automatically disengaged (switched off to disconnect) between the signal pin and ground when the connector is connected and automatically engaged when the connector is disconnected. The self-terminating element 30 may comprise, for example, a switch mechanism and a termination attached to ground, as described below.

Figure 3C:
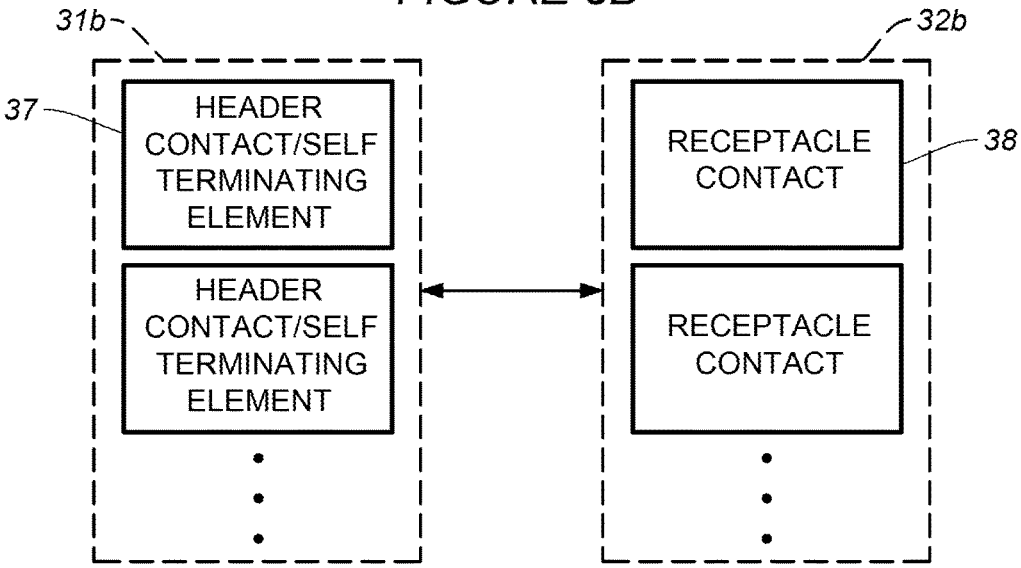
FIG. 3C is a block diagram of one example of connector assembly comprising a plurality of mating receptacle and header contacts.

As shown in FIG. 3C, the header connector 31*b* may comprise an array of header signal contacts 37, and the receptacle connector 32*b* may comprise a corresponding array of receptacle signal contacts 38. Each contact (or set of contacts) 37, 38 may be associated with one or more ground contacts and a self-terminating element 30 (shown in header 31*b* in FIG. 3C). The self-terminating element 30 may instead be located in the receptacle, as shown in FIG. 3A. Thus, the connector (header or receptacle) may comprise any number of contacts and self-terminating elements 30.

It is to be understood that the header connector and the receptacle connector may comprise various configurations at the other end of the connector (non-mating end in FIGS. 3A and 3B). For example, the other end of the connector may comprise a receptacle or header portion or other interface for connection to one or more cables, a linecard, circuit board, backplane, midplane, rack, or another connector. The term "connector" as used herein may refer to any type of connector or device having a mating end comprising either a header or receptacle configured to mate with a corresponding receptacle or header ("mating connection").

Figure 5:
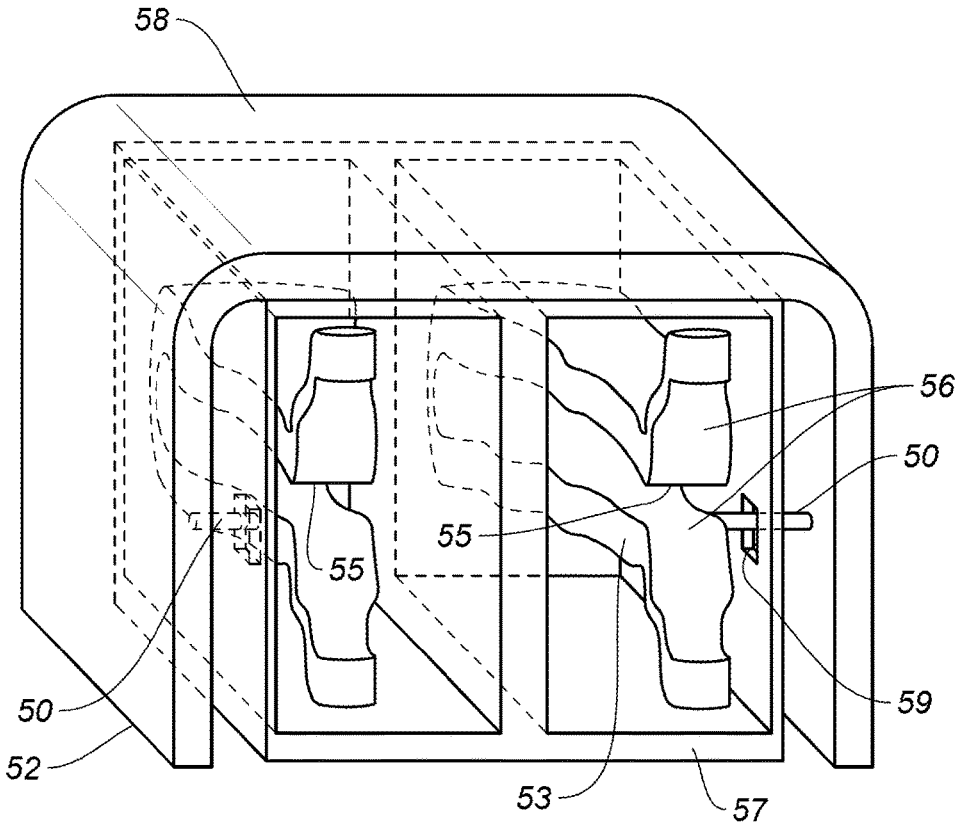
FIG. 5 is a perspective of the receptacle with the self-terminating element in an engaged position, in accordance with one embodiment.
Figure 6:
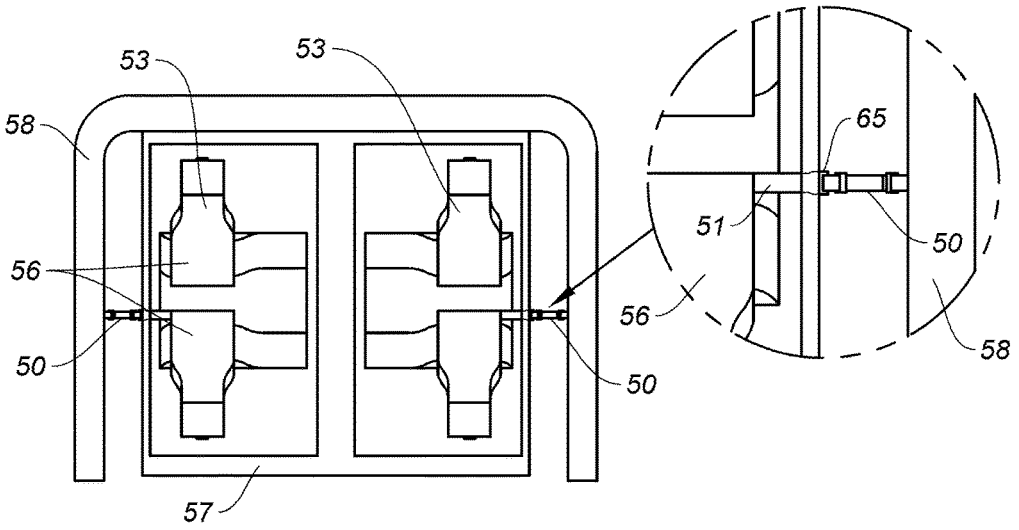
FIG. 6 is a front view of the receptacle shown in FIG. 5 with the self-terminating element in an engaged position.
Figure 7:
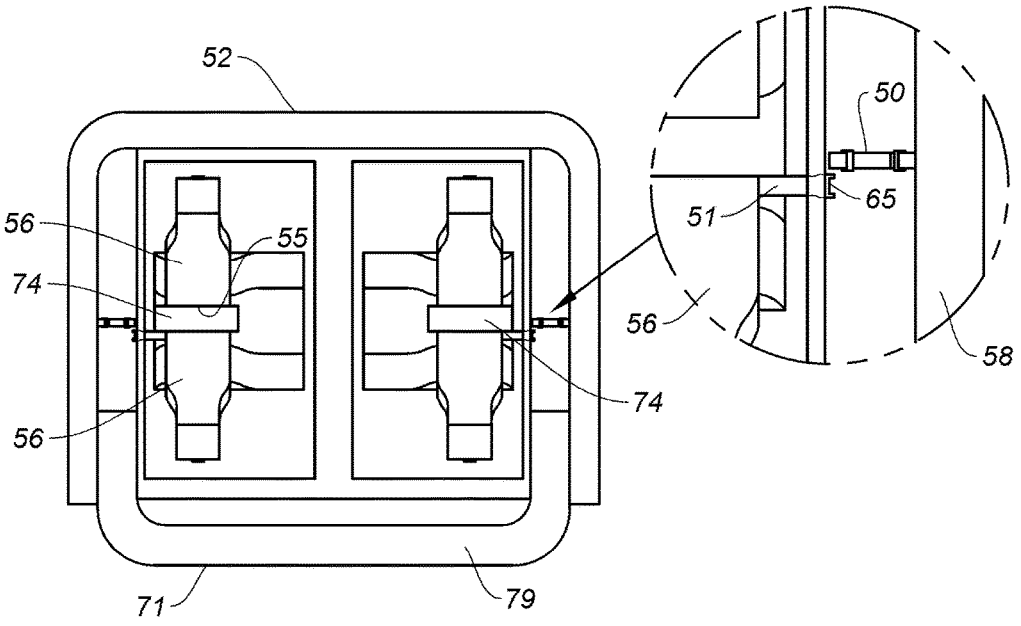
FIG. 7 is a front view of the coupled receptacle and header with the self-terminating element on the receptacle in a disengaged position.

Examples of the self-terminating feature 30 are shown in FIGS. 5-11 and described further below. FIGS. 5-7 illustrate the self-terminating feature located on the receptacle portion of the connector (as shown in FIG. 3A) and FIGS. 8-11 illustrate the self-terminating feature located on the header portion of the connector (as shown in FIG. 3B).

Figure 4:
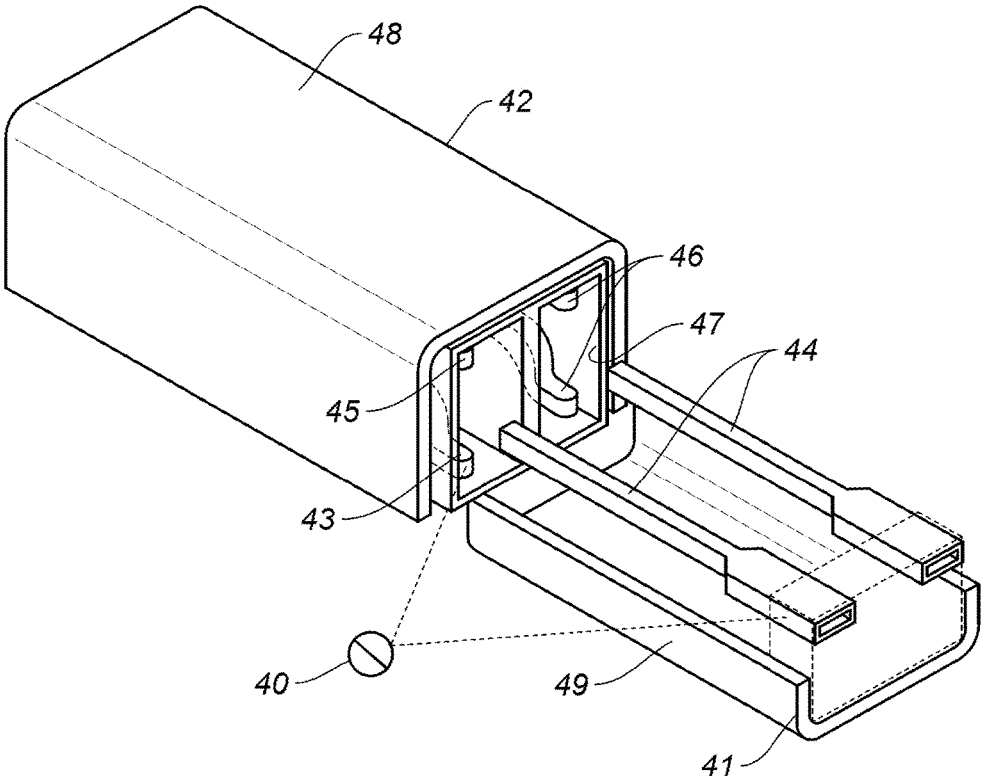
FIG. 4 is a perspective of a receptacle and header in an uncoupled position, in accordance with one embodiment.

FIG. 4 illustrates an example of an uncoupled connector and mating connection, in accordance with one embodiment. The connector or mating connection may comprise, for example, a backplane connector (e.g., backplane connector, midplane connector, ortho-direct connector, and the like), service card (e.g., linecard, fabric card, switch card), server, switch, rack, and the like. One of the connector and mating connection may comprise a header portion 41 and the other of the connector and mating connection may comprise a receptacle (plug) portion 42. As previously described, a self-terminating feature 40 (shown schematically in FIG. 4) may be located on the header 41 or receptacle 42.

FIG. 4 shows a pair of mated signal and ground pins (contacts) 43, 44 in the uncoupled receptacle 42 and header 41. In this example, each pair contains a receptacle signal pin (contact) 43 and a header signal pin (contact) 44 along with mating ground pins (contacts). The contacts 43, 44 may be made from a copper alloy or any other suitable material and may be plated, for example.

The receptacle pins (signal and ground) 43 are configured to receive the two header pins 44 (signal and ground). When the header 41 is inserted into the receptacle 42, each header pin 44 extends axially into a receiving opening (channel, gap) 45 in the receptacle pin 43 and engages and spreads apart resilient contact arms (also referred to as receptacle beams) 46, thus making electrical contact therewith. The arms 46 of the receptacle contact 43 will move radially apart from one another upon receiving the header pin 44 (thereby increasing gap 45) and return to an unloaded position in which the arms are closer together (thereby narrowing the gap 45) when the header pin is removed. The contacts 43, 44 extend rearward from the mating end of the receptacle 42 and header 41 and may be supported by a body or frame (not shown) and configured for connection to another connector, cable, or device (e.g., service card, circuit board, backplane, rack) to form the high-speed link.

In the example shown in FIG. 4, the receptacle signal pins 43 are enclosed in a housing (e.g., plastic housing) 47 and partially covered by a u-shaped shroud (ground shroud) 48, which provides a receptacle ground when the self-terminating element 40 is engaged, as described further below. A u-shaped shroud 49 also extends over a portion of the header contacts 44. The shroud (or shield) 48, 49 helps to provide isolation between terminal pairs in adjacent connectors. The shroud may be formed from any suitable material and configured to interface with the mating connector.

It is to be understood that the header 41 and receptacle 42 shown in FIG. 4 and described above are only examples and that other configurations, including those covered by various standards or codes, or proprietary configurations, may be used without departing from the scope of the embodiments. For example, as described above with respect to FIG. 3C, the connector may comprise any number of contacts (signal, or signal and ground (with any ratio of signal to ground contacts)). Also, it is to be understood that only portions of the connector and mating connection are shown in FIG. 4 and that each component may be located in a connector comprising a plurality of contacts. As previously noted, the non-mating ends of the connectors may also comprise a header or receptacle portion for engagement with another connector or connection. For example, a linecard, backplane, or other structure may include any number of connectors or mating connections, including any number of contacts or self-terminating elements, arranged in various configurations. It is to be understood that FIG. 4 illustrates a simplified view of a single receptacle portion and header portion of a connector and that details for other structures (frame, contact body, housing, etc.) are not shown.

Referring now to FIG. 5, additional details of the receptacle of FIG. 4 are shown, in accordance with one embodiment. In the example shown in FIG. 5, a self-terminating element 50 comprises two rigid members 50 extending generally perpendicular to a longitudinal axis extending along the length of the contacts 53. Each member 50 is fixedly connected to the ground shroud 58 at one end. The other end of the self-terminating member 50 engages with one of the arms 56 of the contact 53 when the self-terminating member is in its engaged position (uncoupled from header portion) as shown in FIG. 5. The self-terminating element 50 disengages or engages based on the opening and closing of the arms (receptacle beams) 56 on the receptacle signal pin (contact) 53 when the header signal pin (contact) is inserted or removed. The receptacle contact arms 56 return to an open (spring biased, unloaded) position whenever the header contacts 44 (FIG. 4) are removed from the opening 55 formed by the arms. In this engaged position, the self-terminating element 50 terminates any signals transmitted to the receptacle contacts 53 to ground. Openings 59 may be formed in the housing 57 to allow the members 50 of the self-terminating element to pass therethrough.

FIG. 6 is a front view of the receptacle shown in FIG. 5 (as viewed from the mating end of the receptacle shown in FIG. 4), with the self-terminating element in its engaged position. As previously noted, one end of the member 50 of the self-terminating element is fixedly connected (e.g., welded, soldered, etc.) to the outer shroud 58. The other end slidably engages with one of the resilient arms 56 of the receptacle contact 53.

As shown in the enlarged view of FIG. 6, the member 50 engages with a finger (tab, rib, protruding member) 51 extending outward from a side of the arm 56 proximate to the housing 57. The engaging finger 51 may be connected to the arm 56 or integrally formed therewith and ensures positive engagement of the self-terminating member 50 with the contact 53 when the self-terminating element is in its engaged position. The finger 51 may comprise, for example, a slot, notch, or rib 65 to assist in retaining the member 50 is in its engaged position, while allowing for disengagement when the header is inserted. When the header pin is removed from the receptacle pin, the arms 56 return to their unloaded position and the engaging member 51 aligns with the self-terminating element member 50 attached to the shroud 58 and any signals received by the pins 53 are terminated to ground through the grounded shroud.

FIG. 7 is a front view of the receptacle 52 shown in FIGS. 5 and 6 coupled with a header 71 (as viewed from the non-mating end of the header shown in FIG. 4). The header pins 74 and shroud 79 are shown inserted into the receptacle 52. The self-terminating element 50 is in a disengaged position to allow normal flow of data with no termination of the signal at the connector. As shown in FIG. 7, the header pins 74 are inserted into the receptacle pins, causing the gap 55 between the arms 56 of the receptacle pins to open up. As the receptacle arms 56 move radially outward, the finger 51 moves as an extension thereof, thereby disengaging the member 50 from the receptacle pin 53 and removing the grounded termination.

It is to be understood that the self-terminating element 50 shown on the receptacle portion of the connector in FIGS. 5-7 is only an example and that other configurations may be used without departing from the scope of the embodiments. For example, the self-terminating element 50 may comprise two mating members engaging at any point between the contact 53 and shroud 58. Also, rigid member 50 may be fixedly attached to the resilient arm for engagement with the shroud 58. A resistive load may be connected to either side of the element 50 (e.g., attached to receptacle contact or shroud) when the self-terminating feature is in its disengaged position (FIG. 7). Also, the self-terminating element 50 may comprise any additional component, structure, groove, notch, etc. to assist in sliding engagement or disengagement, or for retaining the member 50 of the self-terminating element in its engaged position.

Figure 8:
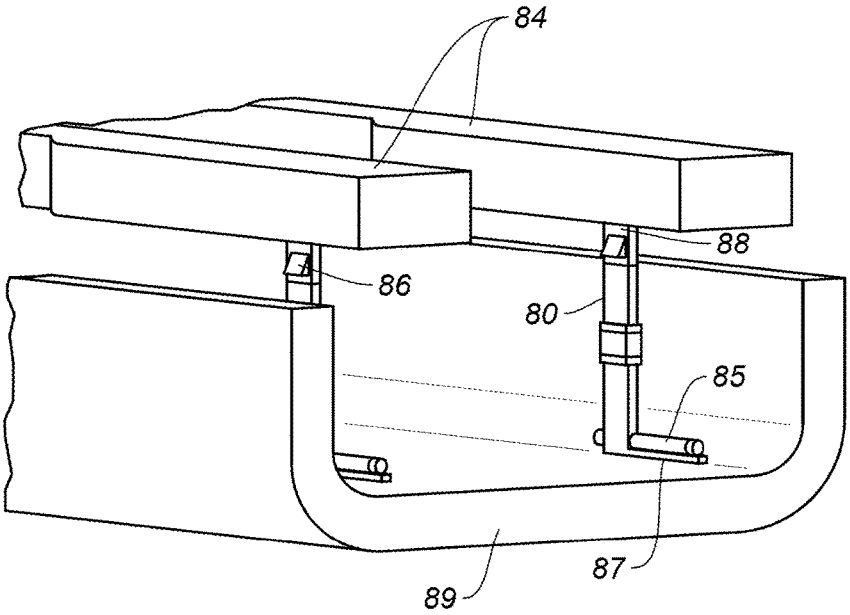
FIG. 8 is a perspective of the header with the self-terminating element in an engaged position, in accordance with one embodiment.
Figure 9:
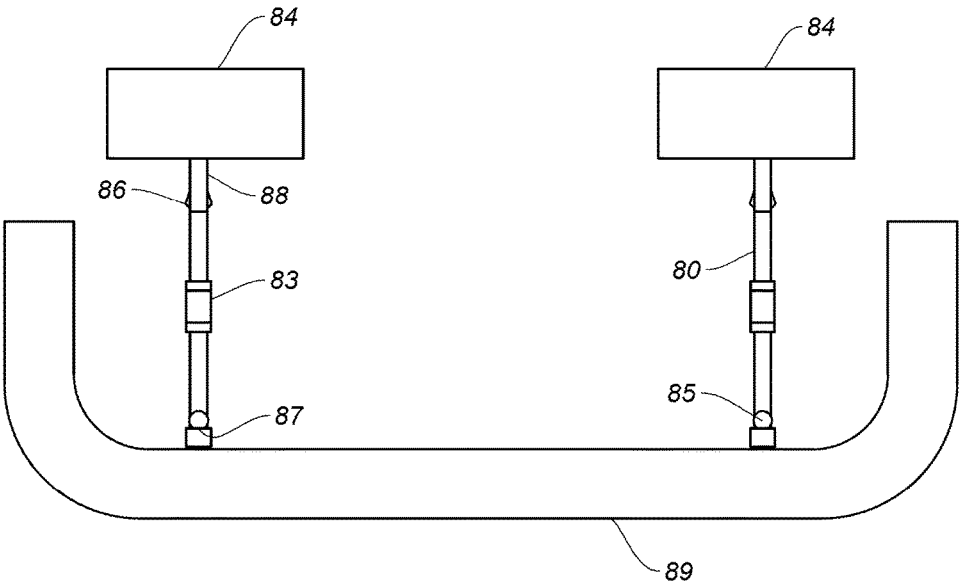
FIG. 9 is a rear view of the header shown in FIG. 8 with the self-terminating element in an engaged position.

As previously noted, the self-terminating element may also be located in the header portion of the connector. FIG. 8 is a perspective rear view and FIG. 9 is a rear view of the header with a self-terminating element in its engaged position (receptacle portion of mating connection removed). In this example, a member 80 of the self-terminating element is slidably connected to the ground shroud 89 and spring loaded to an engaged position with the header contact 84. In the example shown in FIGS. 8 and 9, the self-terminating element includes spring means 85 and track 87 upon which the member 80 may axially slide between an engaged position (shown in FIGS. 8 and 9) and a disengaged position (shown in FIGS. 10 and 11). The spring 85 loads the self-terminating element 80 into position for connection to the signal header pin 84. The member 80 may include a slot 86 for receiving a finger 88 extending outward from a bottom surface (as viewed in FIG. 8) of the contact 84, when the self-terminating element is in its engaged position. The member 80 may include a resistance load (resistor, capacitor) 83.

Figure 10:
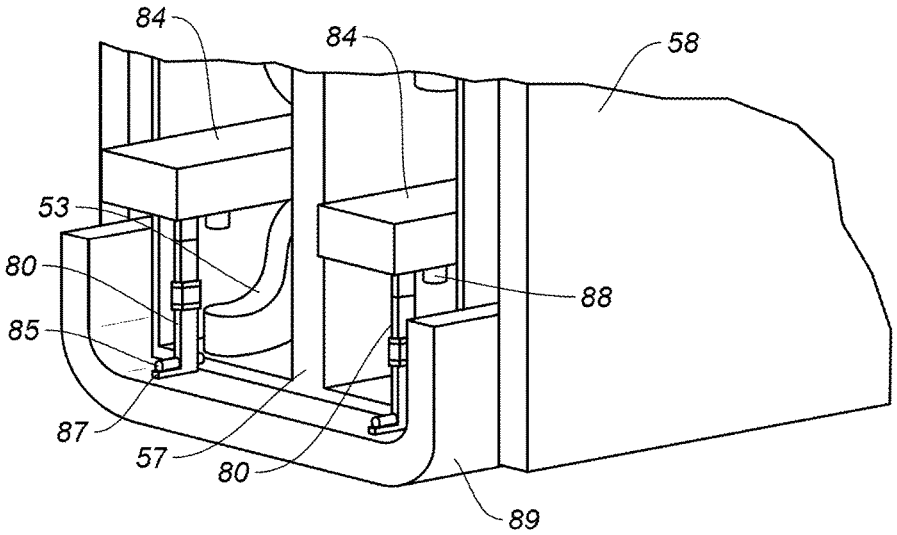
FIG. 10 is a perspective rear view of the coupled header and receptacle with the self-terminating element on the header in a disengaged position.
Figure 11:
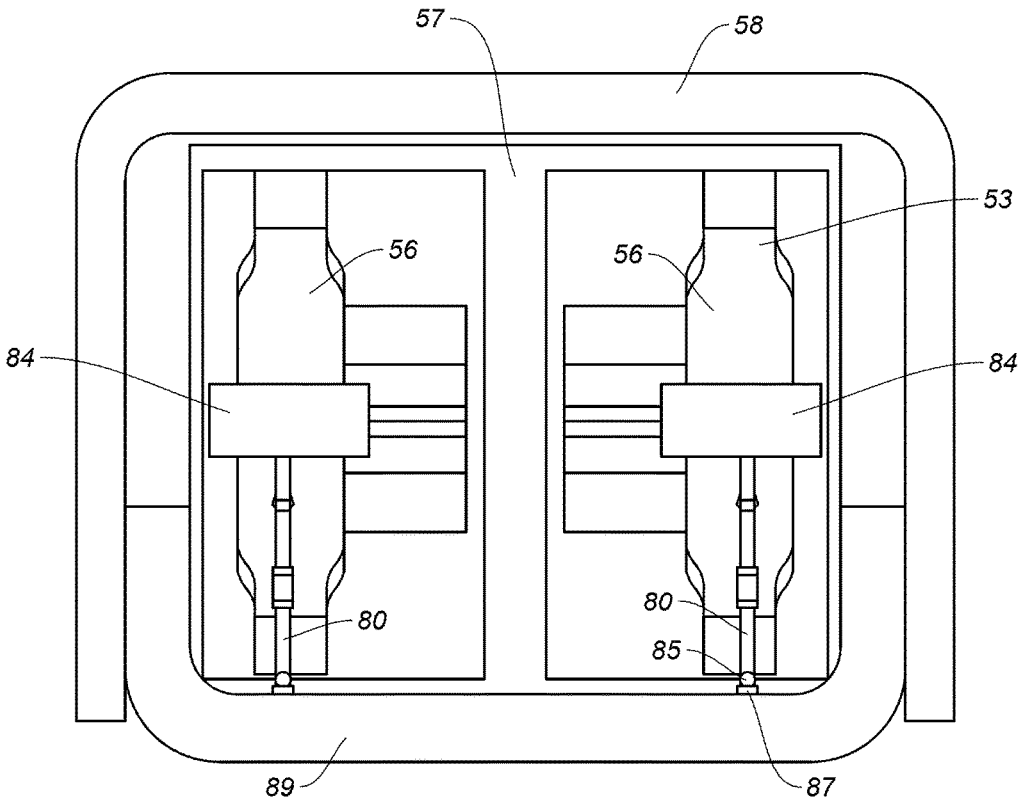
FIG. 11 is a rear view of the coupled header and receptacle shown in FIG. 10 with the self-terminating element in a disengaged position.

FIG. 10 is a perspective rear view and FIG. 11 is a rear view (as viewed from a non-mating end of the header of FIG. 4) illustrating the self-terminating element in a disengaged position with the header inserted into the receptacle. The plastic housing 57 of the receptacle contacts the self-terminating member 80 when the header is inserted into the receptacle and exerts a force on the spring 85, which causes the member to axially slide along the track 87 and disengage from the header pin 84. As shown in FIG. 10, the self-terminating member 80 disengages from the tab (finger) 88 extending from the contact 84 to remove termination to ground and allow signals to pass through from the header contact 84 to the receptacle contact 53.

It is to be understood that the self-terminating feature on the header portion of the connector shown in FIGS. 8, 9, 10, and 11 and described above is only an example and the self-terminating element may have different configurations without departing from the scope of the embodiments. For example, the relative proportions of the member 80 and finger 88 may be different than shown.

The above examples illustrate automatic self-termination of a backplane (e.g., backplane, midplane, ortho-direct) connector. It is to be understood that these are only examples and that the configuration, location, or arrangement of the self-terminating element or its engagement/disengagement or termination means may be different than shown and described herein without departing from the scope of the embodiments. The embodiments described herein may be configured for use with a single-ended termination between a signal pin and a ground pin, for termination between two signal pins (e.g., differential termination), or any other arrangement.

Figure 12:
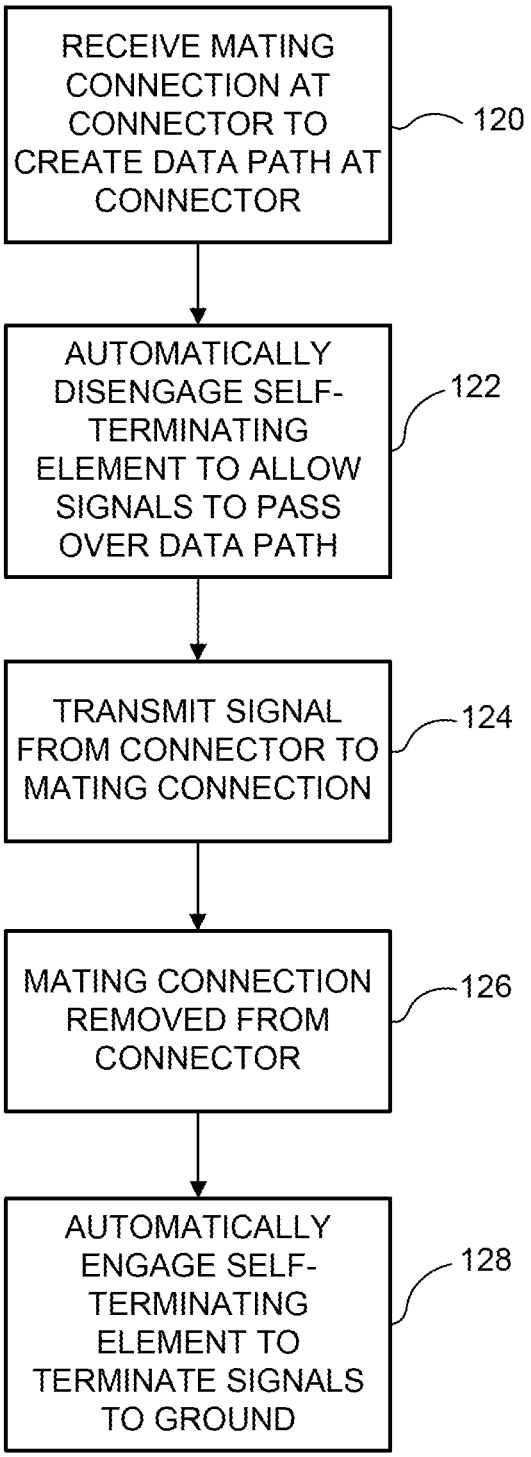
FIG. 12 is a flowchart illustrating an overview of a process for automatic self-termination of a signal at the connector, in accordance with one embodiment.

FIG. 12 is a flowchart illustrating an overview of a method for automatically terminating signals at a connector, in accordance with one embodiment. At step 120, a mating connection is received to create a data path at the connector. For example, a second portion (e.g., receptacle or header) of a connector may be received at a first portion (e.g., other of the receptacle or header) (FIGS. 4 and 12). The self-terminating element is automatically disengaged upon coupling of the connector to allow signals to pass over the data path formed at the connector (step 122). The connector transmits a signal received from a network device to a mating connection (step 124).

When the mating connection is removed from the connector (step 126), the self-terminating element is automatically engaged to terminate the signals to ground (step 128). As previously described, the self-terminating element may be disengaged as components of the mating connection (e.g., header pin, receptacle housing) are removed so that the self-terminating member may return to its original (non-biased) position. After a period of time, software may identify that the connector has been uncoupled and stop transmittal of the signal to the open connector.

It is to be understood that the method shown in FIG. 12 and described above is only an example and that steps may be added, combined, or modified, without departing from the scope of the embodiments.

The embodiments described herein may operate in the context of a data communications network including multiple network devices. The network may include any number of network devices in communication via any number of nodes (e.g., routers, switches, gateways, controllers, edge devices, access devices, aggregation devices, core nodes, intermediate nodes, or other network devices), which facilitate passage of data within the network. The network devices may communicate over one or more networks (e.g., local area network (LAN), metropolitan area network (MAN), wide area network (WAN), virtual private network (VPN) (e.g., Ethernet virtual private network (EVPN), layer 2 virtual private network (L2VPN)), virtual local area network (VLAN), wireless network, enterprise network, corporate network, data center, Internet, intranet, radio access network, public switched network, or any other network).

Figure 13:
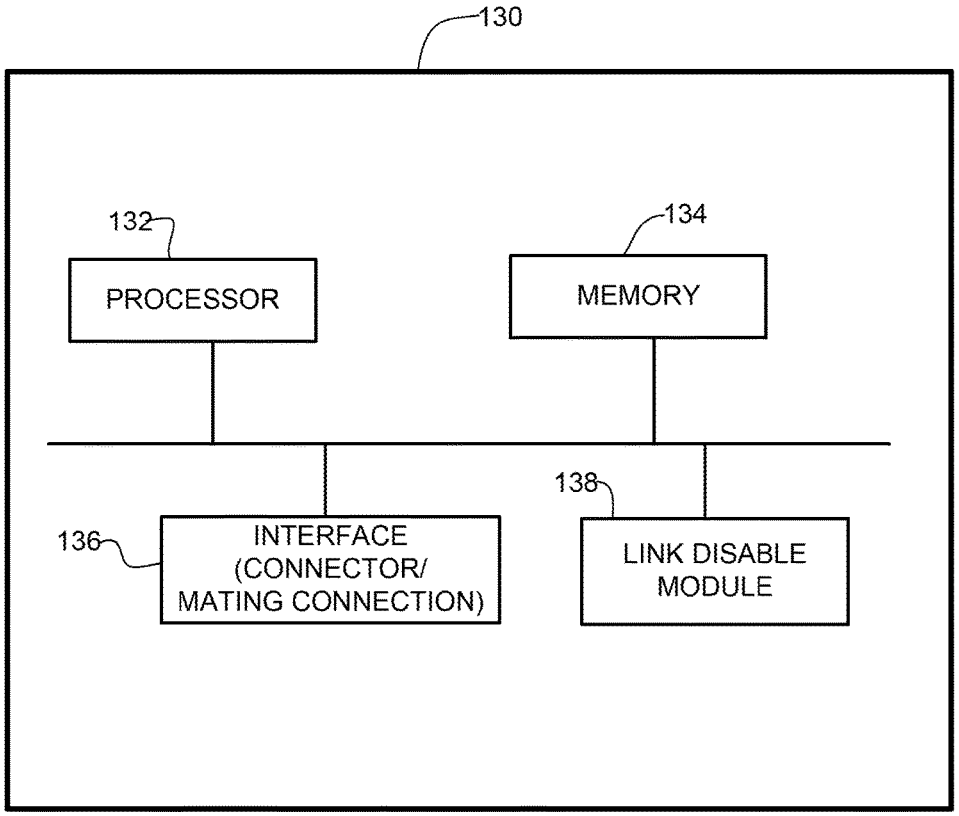
FIG. 13 is a block diagram depicting an example of a network device on which the self-terminating connector may be located.

FIG. 13 illustrates an example of a network device 130 that may be used to implement the embodiments described herein. In one embodiment, the network device 130 is a programmable machine that may be implemented in hardware, software, or any combination thereof. The network device 130 includes one or more processor 132, memory 134, network interface (connector, mating connection) 136, and link disable module 138.

Memory 134 may be a volatile memory or non-volatile storage, which stores various applications, operating systems, modules, and data for execution and use by the processor 132. For example, components of the link disable module 138 (e.g., code, logic, firmware, etc.) may be stored in the memory 134. The network device 130 may include any number of memory components.

Logic may be encoded in one or more tangible media for execution by the processor 132. For example, the processor 132 may execute codes stored in a computer-readable medium such as memory 134. The computer-readable medium may be, for example, electronic (e.g., RAM (random access memory), ROM (read-only memory), EPROM (erasable programmable read-only memory)), magnetic, optical (e.g., CD, DVD), electromagnetic, semiconductor technology, or any other suitable medium. In one example, the computer-readable medium comprises a non-transitory computer-readable medium. The network device 130 may include any number of processors 132.

The network interface 136 may comprise any number of interfaces (connectors, linecards, ports) for receiving data or transmitting data to other devices. The network interface 136 may include, for example, a receptacle or header portion of the connector or mating connection described above.

The link disable module 138 may be configured, for example, to terminate signals after a link disconnect is identified. In one example, the embodiments described herein may be used to provide signal termination during the transition before identification of the open link and termination of the signal takes place at the module 138.

It is to be understood that the network device 130 shown in FIG. 13 and described above is only an example and that different configurations of network devices may be used. For example, the network device 130 may further include any suitable combination of hardware, software, algorithms, processors, devices, components, or elements operable to facilitate the capabilities described herein.

The embodiments described herein may also be used in front end modular optics, in which a limited number of data paths are used. For example, if only half (or any other percentage) of a plurality of data paths are used, the termination described herein may be used to terminate the module, thereby lowering power requirements. In one example, a 400G port may be connected to four separate 100G ports, with one or more not populated. Also, one may be populated with a 50G module in the 100G slot, leaving one lane floating, for example.

As can be observed from the foregoing, the embodiments described herein may provide numerous advantages. For example, one or more embodiments provides automatic termination instantaneously to links that would otherwise be open, to suppress harmful crosstalk noise to adjacent active links. Performance may be improved by reducing disturbance to an operational system.

Although the method and apparatus have been described in accordance with the embodiments shown, one of ordinary skill in the art will readily recognize that there could be variations made to the embodiments without departing from the scope of the invention. Accordingly, it is intended that all matter contained in the above description and shown in the accompanying drawings shall be interpreted as illustrative and not in a limiting sense.

What is claimed is:

1. An apparatus comprising:

a contact contained within a backplane connector configured to couple with a mating connection to provide a high-speed communications data path through the connector;

a ground shroud extending over a portion of the contact; and a self-terminating element movable between an engaged position in which the self-terminating element extends between the contact and the ground shroud when the connector is uncoupled from said mating connection to terminate signals transmitted to the connector, and a disengaged position disengagement when in a disengaged position in which the self-terminating element disconnects the contact from the ground shroud with the connector coupled with said mating connection;

wherein the self-terminating element comprises a member with one end connected to the contact and another end connected to the ground shroud, one of said ends movable relative to the other of said ends to disconnect the contact from the ground shroud.

2. The apparatus of claim 1 wherein said engagement of the self-terminating element reduces crosstalk of the signals from the apparatus to an adjacent connector with an active link.

3. The apparatus of claim 1 wherein the contact comprises two contact pins and wherein the self-terminating element comprises two self-terminating elements, each of the self-terminating elements in contact with one of the contact pins when the self-terminating elements are in said engaged position.

4. The apparatus of claim 1 wherein the self-terminating element provides a resistance load when in said engaged position.

5. The apparatus of claim 1 wherein the ground shroud comprises a u-shaped channel extending axially along a length of the contact and wherein the self-terminating element is connected to the ground shroud.

6. The apparatus of claim 1 wherein the self-terminating element comprises a rigid member connected to one of the ground shroud and the contact.

7. The apparatus of claim 1 wherein the backplane connector comprises one of a backplane connector, a midplane connector, and an orthogonal-direct connector.

8. The apparatus of claim 1 wherein said mating connection comprises a service card.

9. The apparatus of claim 1 wherein the contact is located in a receptacle portion of the connector and comprises a receptacle pin comprising resilient arms for receiving a header pin in a header portion of said mating connection.

10. The apparatus of claim 9 wherein the self-terminating element is configured for said engagement with one of the resilient arms when the self-terminating element is in said engaged position and wherein said resilient arms are configured to move radially apart when the header pin is inserted therein to disengage the self-terminating element from the contact.

11. The apparatus of claim 1 wherein the contact is located in a header portion of the connector and comprises a header pin configured for insertion into a receptacle pin on a receptacle portion of said mating connection.

12. The apparatus of claim 11 wherein said mating connection comprises a housing, and wherein the housing is configured to disengage the self-terminating element from the contact when said mating connection is coupled with the connector.

13. An apparatus comprising:

a backplane connector configured to couple with a mating connection, the connector comprising:

a plurality of contacts configured to mate with said mating connection to provide a high-speed communications data path through the connector; and a plurality of self-terminating elements, each of the self-terminating elements movable between a disengaged position when the connector is coupled to said mating connection and an engaged position in which the self-terminating element extends from one of the contacts to a ground shroud when the connector is uncoupled from said mating connection;

wherein signals are transmitted across the contacts to said mating connection when the self-terminating elements are in said disengaged position, and wherein said signals are terminated to ground when the self-terminating elements are in said engaged position;

wherein the self-terminating element comprises a member with one end connected to the contact and another end connected to the ground shroud, one of said ends movable relative to the other of said ends to disconnect the contact from the ground shroud.

14. The apparatus of claim 13 wherein each of the self-terminating elements comprise a member connected to the contact or the ground shroud extending axially over a portion of the contact, and aligned for engagement with the other of the contact and the ground shroud when the self-terminating element is in said engaged position.

15. The apparatus of claim 13 wherein the connector is configured to provide transmission over the data communications path at a data rate of 50Gb/s or greater when the connector is coupled to said mating connection.

16. The apparatus of claim 13 wherein one of the connector and said mating connection comprises a header portion and the other of the connector and said mating connection comprises a receptacle portion.

17. A method comprising:

transmitting a high-speed signal received from a network device at a backplane connector to a mating connection; and terminating the signal at a self-terminating element at the backplane connector upon removal of said mating connection from the backplane connector;

wherein the self-terminating element is movable from a disengaged position when the backplane connector is coupled to said mating connection to allow the signal to pass therethrough, to an engaged position when said mating connection is removed from the backplane connector to terminate the signal; and wherein the self-terminating element is movable between said engaged position in which the self-terminating element extends between a signal contact and a ground shroud and connects the signal contact to the ground shroud when the connector is uncoupled from said mating connection, and said disengaged position in which the self-terminating element disconnects the connection between the contact and the ground shroud, wherein the ground shroud extends over a portion of the signal contact;

wherein the self-terminating element comprises a member with one end connected to the contact and another end connected to the ground shroud, one of said ends movable relative to the other of said ends to disconnect the contact from the ground shroud.

18. The method of claim 17 wherein the contact comprises a header pin or receptacle arms.

19. The method of claim 17 wherein the backplane connector comprises a plurality of contacts and self-terminating elements.

* * * * *